United States Patent [19]

Campbell

[11] Patent Number: 4,608,845

[45] Date of Patent: Sep. 2, 1986

[54] APPARATUS FOR FABRICATING HONEYCOMB CORE STRIP

[75] Inventor: James R. Campbell, South Laguna, Calif.

[73] Assignees: Thomas P. Mahoney, Balboa Island; Donald A. Ruston; Robert S. Barnes, both of Newport Beach, all of Calif. ; part interest to each

[21] Appl. No.: 615,084

[22] Filed: May 29, 1984

[51] Int. Cl.[4] ..... B21D 13/10

[52] U.S. Cl. ..... 72/44; 72/196

[58] Field of Search ..... 72/44, 187, 196; 242/118.5

[56] References Cited

U.S. PATENT DOCUMENTS

| | | | |
|---|---|---|---|
| 1,915,113 | 6/1933 | Wood et al. | 72/196 |
| 2,907,369 | 10/1959 | Brauer | 72/44 |
| 3,017,132 | 1/1962 | Gnage et al. | 242/118.5 |
| 4,319,473 | 3/1982 | Franke, Jr. et al. | 72/196 |
| 4,327,840 | 2/1969 | Richter | 72/44 |

*Primary Examiner*—Lowell A. Larson

*Attorney, Agent, or Firm*—Thomas P. Mahoney

[57] ABSTRACT

An apparatus for forming honeycomb-type core strip includes a source of metallic ribbon, form gears for forming a desired configuration in the ribbon and take-up means for taking up the core strip as it is issued from the form gears. Interposed between the source and take-up means is lubricating means for insuring adequate lubrication of the metallic ribbon as it enters the bite of the form gears. The form gears are characterized by a configuration which enables them to impart hinge means to the ribbon which facilitates the utilization of the ribbon in unitary metallic seal constructions wherein a continuous length of the ribbon is bent into helical form.

6 Claims, 11 Drawing Figures

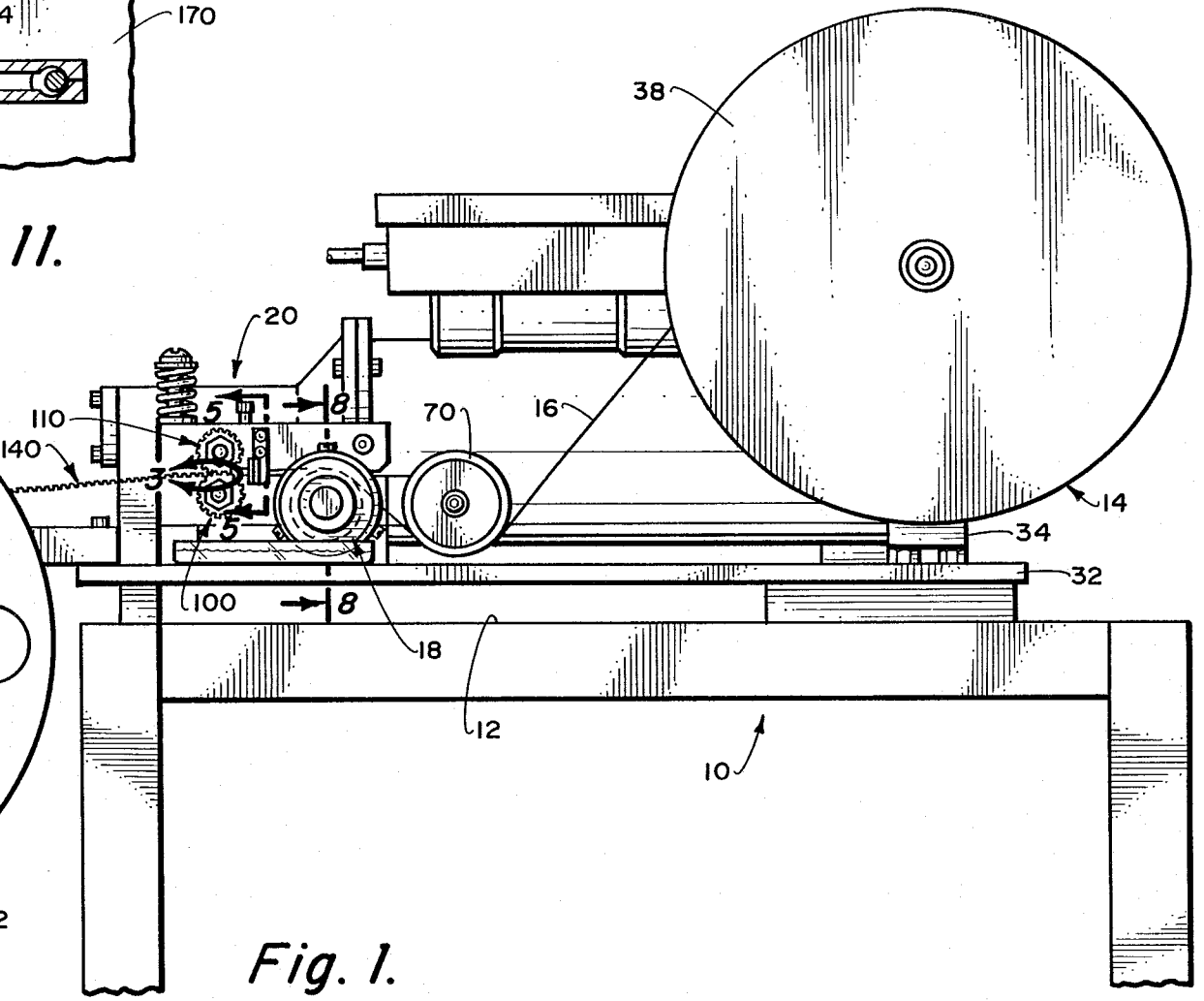
Fig. 1.
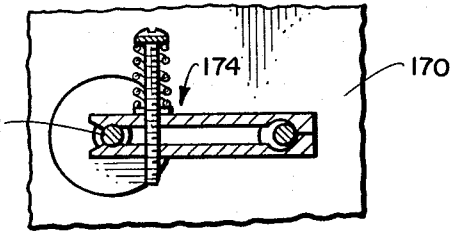
Fig. 11.
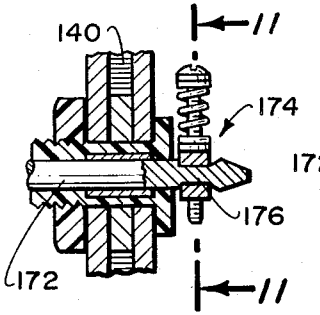
Fig. 10.
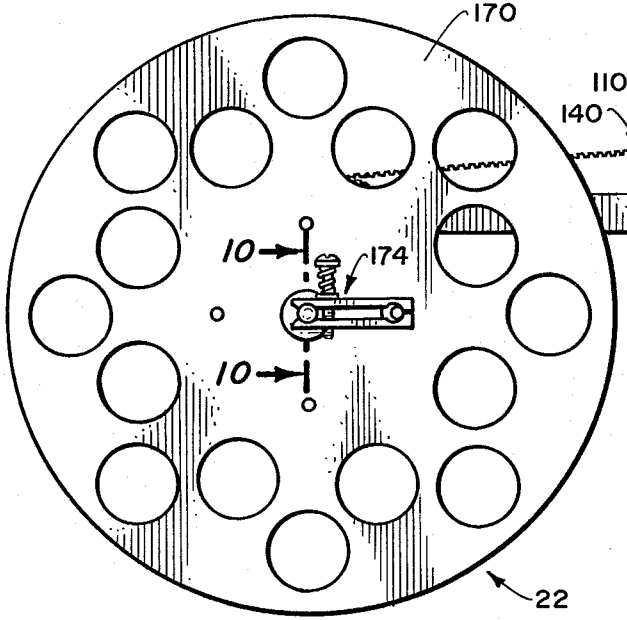

APPARATUS FOR FABRICATING HONEYCOMB CORE STRIP

BACKGROUND OF THE INVENTION

This invention relates to an apparatus for fabricating honeycomb core strip and, more particularly, to an apparatus for fabricating honeycomb core strip of the type utilized and disclosed in my co-pending application for U.S. patent Ser. No. 457,168, filed Jan. 13, 1983, and entitled HONEYCOMB SEAL STRUCTURE.

A co-pending application entitled METHOD AND APPARATUS FOR FABRICATING HONEYCOMB SEAL structure is Ser. No. 503,542, filed June 13, 1983.

It is well known to those skilled in the art that conventional honeycomb core strip for fabricating honeycomb core may be preformed into the desired conventional corrugated configuration by a wide variety of different types of machines. In some instances, the core strip may be fabricated by various types of tools which can be utilized in punch presses or the like to stamp the configuration of the core strip into an elongated metal blank.

In other machines gears are utilized to form a configuration in the core strip which will result in a hexagonal cell when the core strip is joined with a mating core strip in the process of fabricating the desired honeycomb core.

However, all of the machines described hereinabove have been designed to fabricate conventional core strip and would not be capable of fabricating the hinged core strip which has been previously disclosed in the above-referenced co-pending applications.

This is due to the fact that the hinged core strip of my invention is characterized by the provision of hinges at the nodes thereof which materially enhances the ability of the core strip to sustain significant deformation as it is wound into the helical configuration of the honeycomb seal structure defined in the co-pending application directed to such structure.

OBJECTS AND ADVANTAGES OF THE INVENTION

The ultimate object of my invention is the provision of an apparatus for fabricating hinged honeycomb core strip which is capable of being deformed into a helical configuration for use in a sealing ring, shaft seal or similar construction and which is characterized by the provision of an integral hinge in the nodal areas thereof.

The apparatus of my invention is characterized by the fact that it is capable of continuously deforming an elongated strip or blank of the requisite material from which the core strip is formed and which imparts to said blank the precise configuration characterized by the hinged configuration of the resulting core strip.

An additional object of my invention is the provision of an apparatus of the aforementioned character which is capable of forming core strips of different dimensions, such as height and width, to provide different cell sizes resulting from the juxtaposition of identically configured core strips.

A further object of my invention is the provision of an apparatus of the aforementioned character which is characterized by the provision of pre-tensioning means adapted to impart a predetermined load to the core strip blank as it is fed to forming gears which impart the desired configuration to the core strip blank.

An additional object of my invention is the provision of an apparatus of the aforementioned character which incorporates a source of metallic ribbon and drive means located adjacent said source for feeding said metallic ribbon to forming means constituted by a pair of form gears, with one of the gears being connected to the drive means and constituting a drive gear and the other of said gears being an idler gear. The drive gear and idler gear intermesh to form the ribbon into a corrugated core strip and have cooperating protrusions and recesses which impart hinge points to the nodal areas of the core strip.

A further object of my invention is an apparatus of the aforementioned character wherein the idler gear is subjected to biasing means whereby said idler gear is biased toward said drive gear to cause the conjoint rotation of said idler and drive gears and to adjust the forces betwen the gears so as to allow the proper forming of materials of different widths, thicknesses and tempers.

An additional object of my invention is the provision of an apparatus of the aforementioned character wherein automatic lubricating means is provided in the path of advancement of the core strip blank to impart sufficient lubrication to the surface of said blank to facilitate the deformation thereof by said drive and idler gears.

Another object of my invention is the provision of a take-up reel adapted to receive the properly formed core strip from the output side of said drive and idler gears.

Other objects and advantages of my invention will be apparent from the following specification and the accompanying drawings.

BRIEF DESCRIPTION OF THE DRAWINGS

FIG. 1 is a side elevational view of an embodiment of the apparatus constructed in accordance with the teachings of my invention;

FIG. 10 is an enlarged fragmentary sectional view taken on the broken line 10—10 of FIG. 1; and FIG. 11 is an enlarged fragmentary side elevational view, partially in section, taken on the broken line 11—11 of FIG. 10.

DESCRIPTION OF PREFERRED EMBODIMENTS OF THE INVENTION

Figure 2:
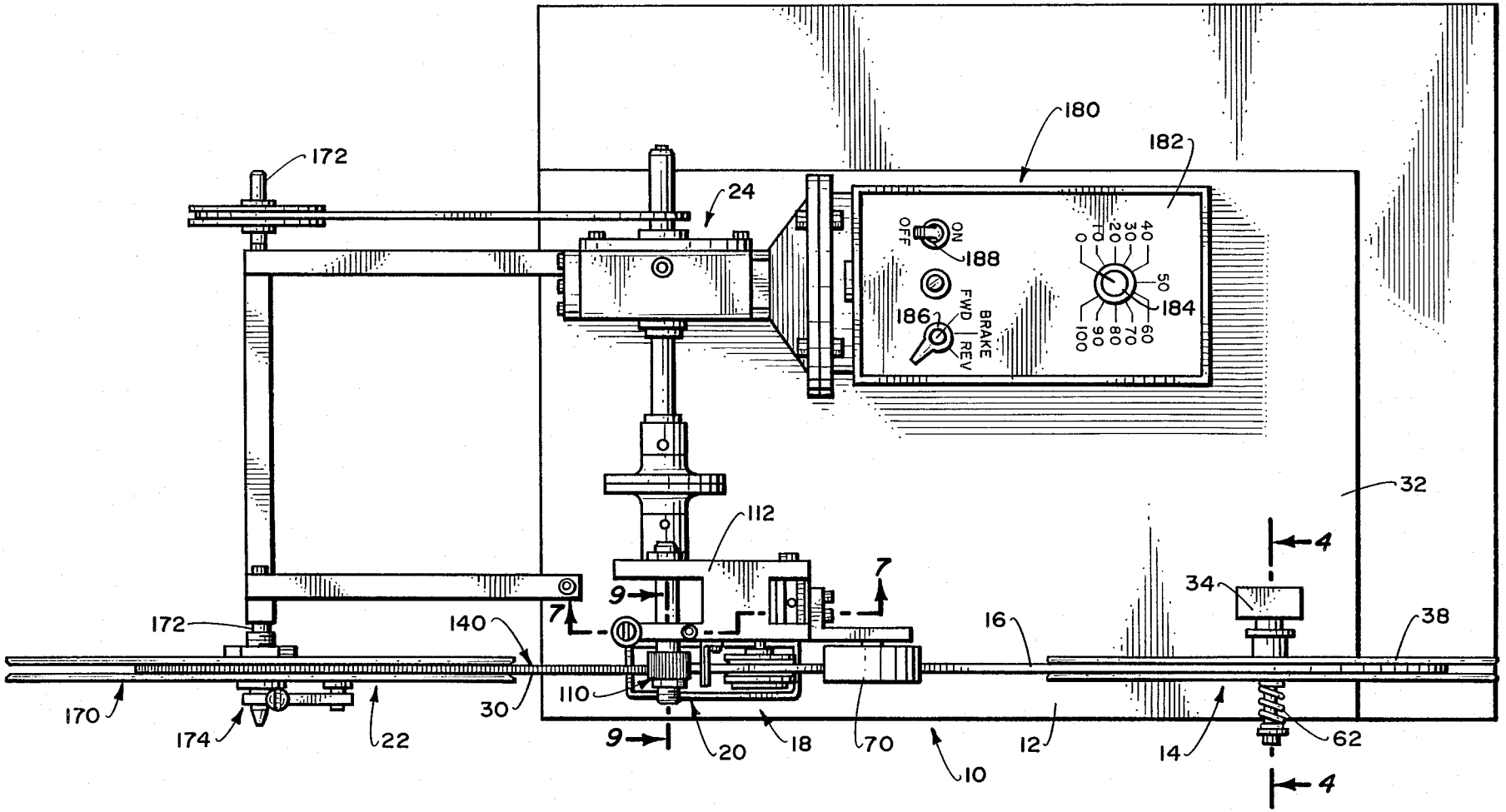
FIG. 2 is a top plan view of the apparatus of FIG. 1.

Referring to the drawings, and particularly to FIGS. 1 and 2 thereof, I show a core strip forming apparatus 10 which is mounted on a table 12 and which includes a source 14 of core strip blank 16; a lubricating station 18; a forming station 20 and a takeup station 22.

Associated with the forming station 20 and take-up station 22 is drive means indicated generally at 24. The drive means 24 includes an electric drive motor, not shown, and is adapted, in a manner to be described in greater detail below, to control the speed and direction of the core strip blank and completed core strip 30.

Figure 4:
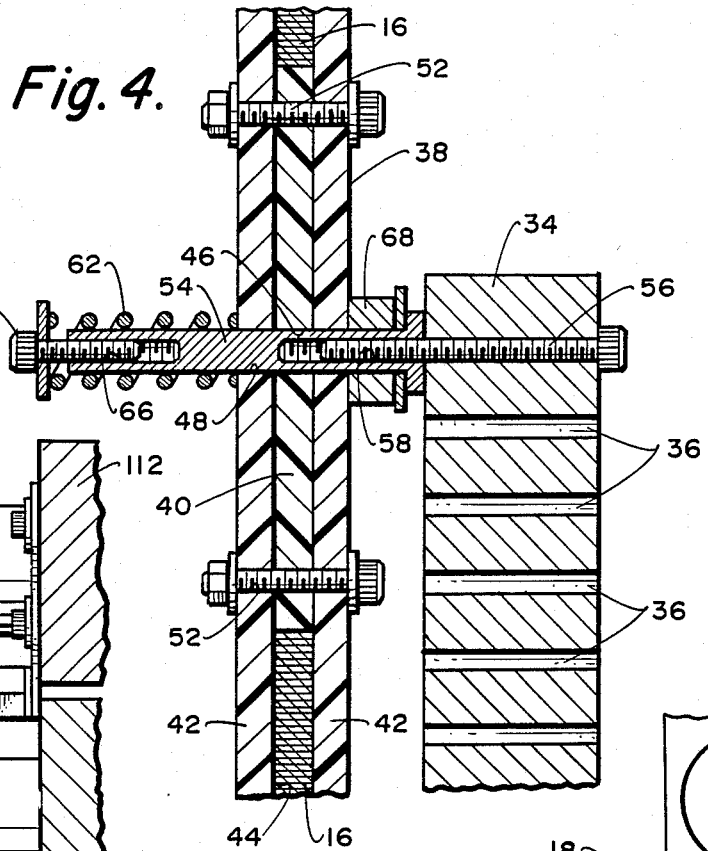
FIG. 4 is a transverse sectional view taken on the broken line 4—4 of FIG. 2 illustrating the mounting of the supply reel of the apparatus.

Secured to a bed 32 supported on the table 12 is a standard 34 which, as best shown in FIG. 4 of the drawings, includes a plurality of mounting bores 36. The mounting bores 36 serve to mount a variety of different sizes of reels 38 which constitute the source 14 of the core strip blank 16. In other words, the greater the diameter of the reel 38, the higher the bore 36 in which the reel 38 will be mounted to permit the perimeter of the reel 38 to clear the surface of the bed 32 as it is rotated, in a manner to be described in greater detail below.

The reel 38, as best shown in FIG. 4 of the drawings, includes a hub 40 having a pair of circular side plates 42 mounted thereupon and defining an annular recess 44 for receiving the wound length of core strip blank. The hub and side plates 40 and 42 have coincident bores 46 and 48, respectively, and are maintained in operative relationship with each other by bolt and nut assemblies 52.

A shaft 54 is mounted in operative relationship with the standard 34 by an elongated bolt 56 threadedly engaged in a corresponding bore 58 in said shaft.

Mounted on the protruding extremity of the shaft 54 is a compression spring 62 which can be adjusted by a bolt and washer combination 64, said bolt being threadedly engaged in corresponding bore 66 in the extremity of the shaft 54.

A spacer assembly 68 encompasses the shaft 54 and spaces the relevant circular plate 42 from operative engagement with the standard 34. Consequently, as core strip blank 16 is drawn from the reel constituting the source of blank 16, the hub 40 and side plate 42 are rotated relative to the shaft 54 and the tension at which the blank 16 is fed is controlled, in part, by adjustment of the compression spring 62 which acts as a clutch to prevent overrunning or freewheeling of the reel about the shaft 54.

Of course, if it is desired to fabricate wider core strip than can be fabricated with the reel 38, a reel of appropriate dimensions can be substituted for the reel shown in the drawings, or a thicker hub 40 can be inserted between the circular side side plates 42 to accept a wider core strip blank 16.

Figure 5:
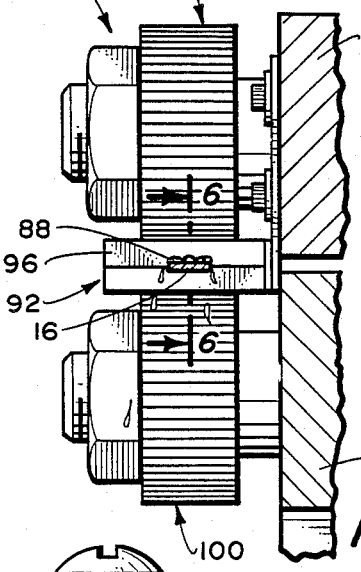
FIG. 5 is a vertical sectional view taken from the broken line 5—5 of FIG. 1.
Figure 6:
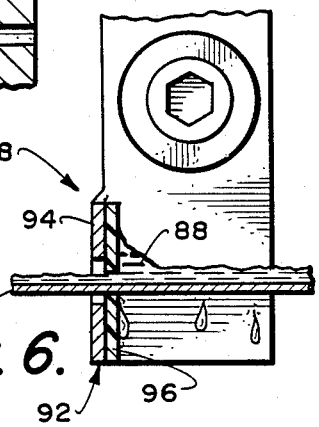
FIG. 6 is an enlarged fragmentary sectional view taken on the broken line 6—6 of FIG. 5.
Figure 8:
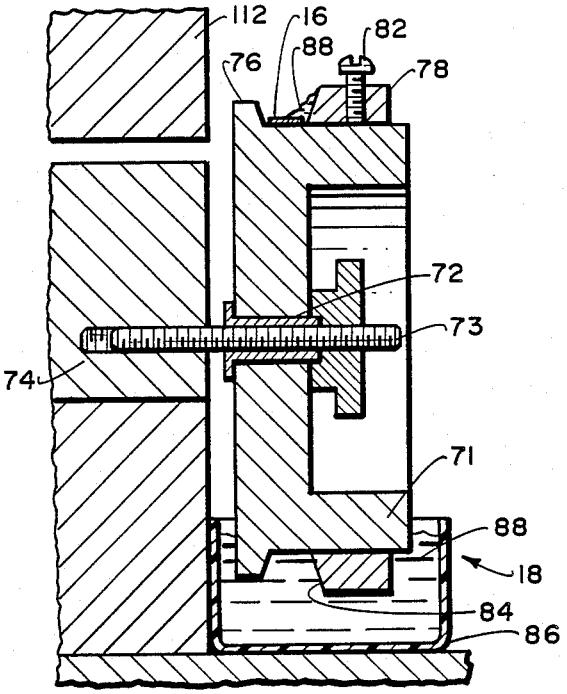
FIG. 8 is an enlarged vertical sectional view taken from the broken line 8—8 of FIG. 1.
Figure 9:
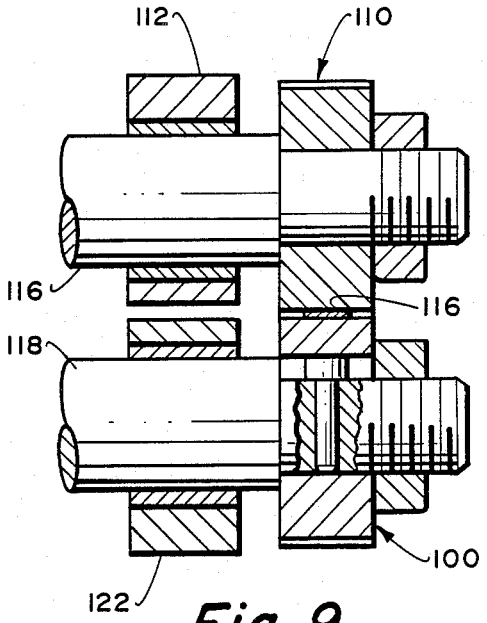
FIG. 9 is an enlarged fragmentary sectional view taken on the broken line 9—9 of FIG. 2.

The lubricating station 18, as best shown in greater detail in FIGS. 6 and 8, and fragmentarily in FIG. 5 of the drawings, includes a guide roller 71 which is provided with a bearing 72 which is, in turn, mounted upon a shaft 73 threadedly engaged in a support 74.

The guide roller 71 includes a flange 76 and an adjustable ring 78 incorporating an adjustable set screw 82. The ring 78, together with the flange 76, defines an adjustable groove 84 for the reception of the core strip blank 16, as best shown in FIG. 8 of the drawings.

A trough 86 of suitable lubricant is disposed in such a manner that the guide roller 71 has its lower ambit of rotation disposed in the lubricating fluid and said roller carries the lubricating fluid upwardly, as best shown in FIG. 8 of the drawings, to properly lubricate the core strip blank 16 as it passes over the guide roller.

As the core strip blank 16 is drawn toward the forming station 20, the core strip blank with the lubricating fluid, indicated at 88, deposited thereupon is drawn through a wiper assembly 92 consisting of a slotted metal wiper plate 94 and a fibrous slotted wiper 96. Actually, the wiper plate 94 is constituted by two separate elements defining the slot for the passage of the core strip blank 16 as is the fibrous wiper 96. The dimensions of the slots in the respective wiper plate 94 and fibrous wiper 96 can be changed by substitution of new wiper plates and wipers to accommodate core strip blank 16 of different widths to provide for less or more effective removal of the lubricating fluid 88.

Figure 3:
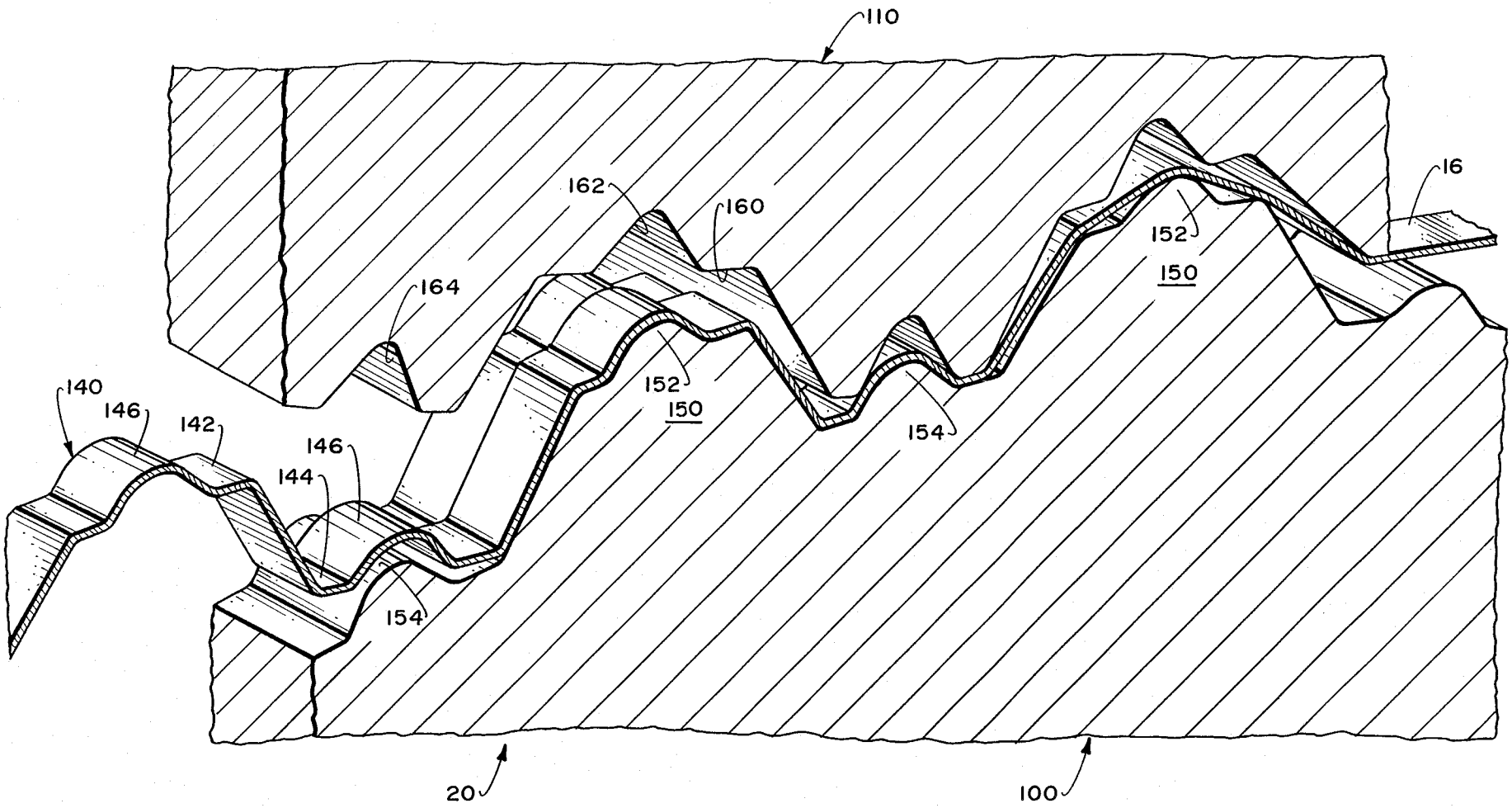
FIG. 3 is an enlarged fragmentary sectional view of the idler and drive gear profiles taken on the broken line 3—3 of FIG. 1 and illustrating the manner in which the idler and drive gears cooperate to form the hinge in the core strip blank as it is fed between the cooperative teeth and recesses of said gears.

Located at the forming station 20 are drive and driven form gears 100 and 110, respectively, said drive and driven gears being designed, in a manner shown in detail in FIG. 3 of the drawings to impart the desired configuration to the core strip blank 16.

Figure 7:
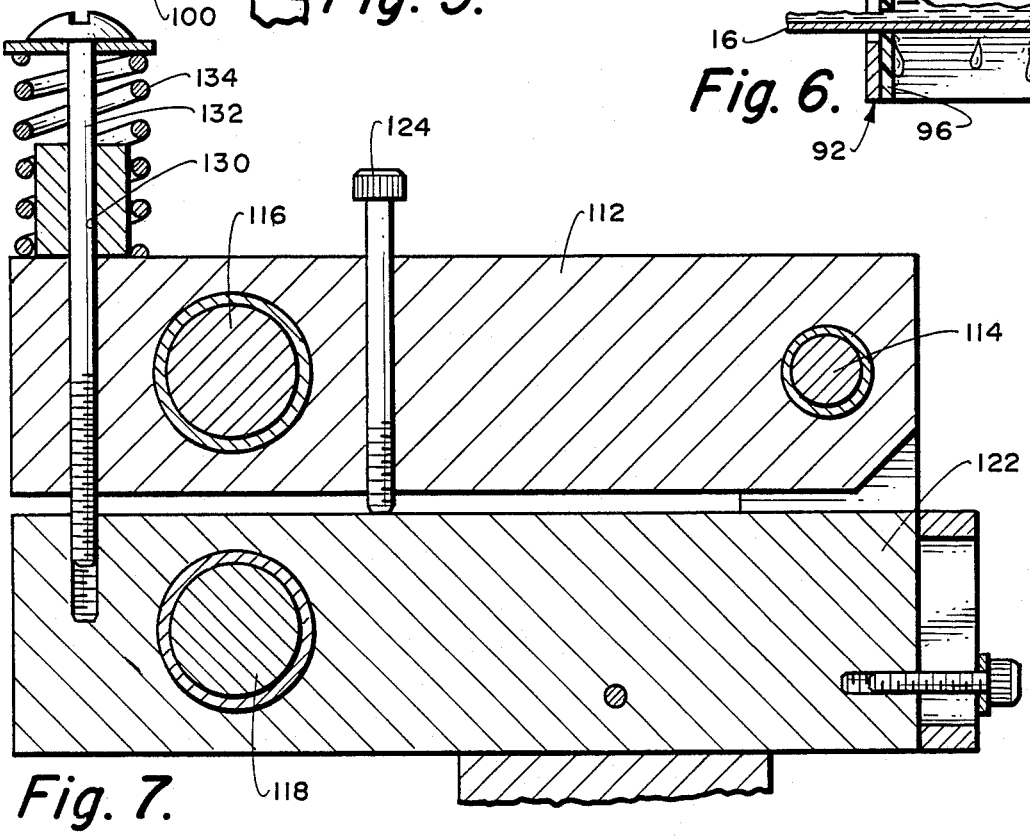
FIG. 7 is an enlarged fragmentary view taken from the broken line 7—7 of FIG. 2.

In order to insure the optimum interaction between the drive gear 100 and the driven gear 110, the driven gear 110 is mounted in a pivotally supported carriage 112, said carriage, as best shown in FIG. 7 of the drawings, rotating about a pivot 114 which supports a shaft 116 for the driven gear 110. The shaft 118 for the drive gear 100 is mounted in a fixed block 122. Interposed between the fixed block 122 and the pivotally mounted carriage 112 is a limit stop pin 124 which, as best shown in FIG. 7 of the drawings, is engageable with an adjacent surface of the fixed block 122 to urge the carriage 112 away from the fixed block 122 and, thus, spacing of the shafts 116 and 118 and the consequent mating of the drive and driven gears 100 and 110, respectively.

When the lower end pin 124 is urged downwardly by rotation, it urges the carriage 112 away from the fixed block 122 to open the gears 100 and 110 and thus permit removal or installation of core strip 16 from or on the gears 100 and 110.

Interposed between and operatively connecting the carriage 112 and the fixed block 122 is an adjustment assembly 130 consisting of an adjustment screw 132 which biases a compression spring 134 so as to adjust the forces between the gears.

The core strip 140 which issues from the forming station 20 and is formed by the interaction of the drive and driven gears 100 and 110, respectively, is characterized by a generally corrugated configuration and has zenith and nadir nodal areas 142 and 144, FIG. 3 of the drawings. Formed upon the zenith and nodal areas 142 and 144 are protrusions or ribs 146 which constitute hinge points on the zenith and nadir nodal areas 142 and 144 in a manner described in greater detail in my copending applications set forth hereinabove.

It is the function of the drive and driven form gears 100 and 110 to provide the basic corrugated shape of the core strip 140 and to simultaneously form the ribs 146 which constitute the hinges in the core strip.

The showing of the form gears 100 and 110 in FIG. 3 of the drawings is greatly enlarged to illustrate the manner in which the basic corrugated shape of the core strip 140 and the hinge ribs 146 is achieved. As the rotation of the drive form gear 100 causes corresponding rotation of the driven gear 110, the core strip blank 16 is drawn between the cooperative portions of the drive and driven gears 100 and 110.

These cooperative portions include teeth 150 on the drive form gear 100 which have hinge forming bosses 152 on the apices or crowns of the teeth 150 and corresponding hinge forming bosses 154 at the roots thereof. The remaining portions of the teeth impart the general corrugated configuration to the core strip 140.

Cooperating with the teeth 150 on the drive gear 100 are corresponding receptacles 160 formed in the driven gear 110 and incorporating hinge forming means 162 cooperative with the corresponding hinge forming means 152 of the teeth 150 of the drive gear 100. Also provided in the driven gear 110 are rib forming means 164 cooperative with the rib forming means 154 provided upon the drive gear 100.

It will be apparent from a study of FIG. 3 of the drawings that, as the core strip blank 16 passes between the previously described cooperative portions of the drive and driven gears 100 and 110, it is progressively formed into the desired configuration in which the basic corrugated configuration of the core strip 140 is achieved and the ribs 146 constituting the hinges on said core strip are provided.

After the core strip 140 issues from the forming station 20 it passes to the take-up station 22 which includes a take-up reel 170 which, as best shown in FIGS. 1–2 and 10–11, is supported upon a shaft 172 driven by the drive means 24. A clutch 174 mounted on the take-up reel 170 engages an extremity of the shaft at 176 and prevents the take-up reel from imposing an undue tensional load upon the core strip 140 as it passes through the forming station 20.

Shown at 180 in FIG. 2 of the drawings is the control panel 182 for the drive means 24. The panel 182 includes a speed control 184, a directional control and brake 186, and an on-and-off switch 188. Therefore, the speed at which the core strip 140 is fabricated can be controlled precisely to achieve optimum results.

I thus provide by the apparatus of my invention an apparatus which is particularly adapted for the precise formation of the relatively minute hinge ribs 146 in the corrugated core strip 140 on a continuous, automatic basis. The apparatus, as indicated hereinabove, is adapted to be adjusted to receive core strip blank 16 of various dimensions in order that core strip 140 may be provided in the required sizes for intended uses. By the balancing of the tensional loads imposed upon the core strip blank and the resulting core strip through the utilization of the clutches in association with the feed and take-up reels, the elimination of undue tensional stresses on the core strip blank and resulting core strip is achieved.

I claim:

1. In an apparatus for fabricating metallic core strip for use in creating a honeycomb structure wherein the male nodes of said strip are juxtaposed to and engage the female nodes thereof, the combination of: a source of metallic ribbon; drive means located adjacent said source; and forming means connected to said drive means, said forming means including a pair of form gears, one of said gears being connected to said drive means and constituting a drive gear and the other of said gears being an idler gear, said drive gear and said idler gear having interengaged teeth to form said ribbon into a corrugated core strip and said drive and idler gears having cooperating protrusions and recesses, respectively, thereupon and therein to provide hinge points in said core strip, said protrusions being constituted by ribs on the apices of the teeth of said drive gear and said recesses being provided at the root between adjacent teeth of said idler gears.

2. The apparatus of claim 1 including mounting means for said drive and idler forming gears.

3. The apparatus of claim 2 in which said mounting means incorporates means for biasing said idler gear toward said drive gear.

4. The apparatus of claim 1 in which lubricating means is interposed between said metallic ribbon source and said form gears.

5. The apparatus of claim 4 in which said lubricating means includes wiper means for controllling the amount of lubricant remaining on said metallic ribbon prior to its entry into the bite of said driving and idler form gears.

6. A set of form gears for corrugating a metallic ribbon into a core strip, said ribbon having zenith and nadir corrugations therein, said corrugations having portions abutting each other when adjacent ribbons are aligned to form a honeycomb pattern, said abutting portion of said zenith corrugation having a male protruberance thereupon and said nadir abutting portion having a female receptacle therein for the reception of said male protruberance, wherein said forming gears include a drive gear and an idler gear and said drive and idler gears have intermeshing teeth whose apices are adapted to form the abutting portions of said strip, the apices of said drive gear being provided with protruberances constituted by ribs and the roots between the teeth of said idler gear being provided with recesses for the reception of said protruberances whereby said male protruberances and female recesses may be formed in said abutting portions of said zenith and nadir corrugations.

* * * * *